US010238256B2

(12) United States Patent
Cole et al.

(10) Patent No.: US 10,238,256 B2
(45) **Date of Patent: *Mar. 26, 2019**

(54) VACUUM CLEANER TOOL

(71) Applicant: Dyson Technology Limited, Wiltshire (GB)

(72) Inventors: Samuel Steven Cole, Swindon (GB); Brian McVeigh, Bristol (GB); Peter David Gammack, Swindon (GB); James Dyson, Bristol (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 549 days.

This patent is subject to a terminal disclaimer.

(21) Appl. No.: 14/768,725

(22) PCT Filed: Feb. 17, 2014

(86) PCT No.: PCT/GB2014/050457

§ 371 (c)(1),
(2) Date: Aug. 18, 2015

(87) PCT Pub. No.: WO2014/128443

PCT Pub. Date: Aug. 28, 2014

(65) Prior Publication Data

US 2015/0374186 A1 Dec. 31, 2015

(30) Foreign Application Priority Data

Feb. 19, 2013 (GB) ..... 1302905.3
Feb. 19, 2013 (GB) ..... 1302906.1

(51) Int. Cl.
*A47L 9/02* (2006.01)
*A47L 9/06* (2006.01)

(52) U.S. Cl.
CPC ..... *A47L 9/066* (2013.01); *A47L 9/02* (2013.01); *A47L 9/062* (2013.01); *A47L 9/0666* (2013.01)

(58) Field of Classification Search
CPC . A47L 9/066; A47L 9/02; A47L 9/062; A47L 9/0666; A47L 9/06; A47L 9/0673; A47L 9/0613; A47L 9/0653
See application file for complete search history.

(56) References Cited

U.S. PATENT DOCUMENTS 921,669 A 5/1909 Boegel et al.
1,033,016 A 7/1912 Hope
(Continued)

FOREIGN PATENT DOCUMENTS

CH 165488 11/1933
DE 689 460 3/1940
(Continued)

OTHER PUBLICATIONS

International Search Report and Written Opinion dated Aug. 25, 2014, directed to International Application No. PCT/GB2014/050457; 17 pages.
(Continued)

*Primary Examiner* — Robert J Scruggs
(74) *Attorney, Agent, or Firm* — Morrison & Foerster LLP

(57) ABSTRACT

A tool for a vacuum cleaner that comprises a nozzle and a bristle assembly. The nozzle comprises an elongate suction opening. The bristle assembly, which is mounted within the nozzle and protrudes through the suction opening, comprises a carrier to which a strip of bristles is attached.

19 Claims, 7 Drawing Sheets

(56) References Cited

U.S. PATENT DOCUMENTS

| | | | | |
|---|---|---|---|---|
| 1,633,598 | A | 6/1927 | McClatchie | |
| 1,663,365 | A | 3/1928 | Wise et al. | |
| 1,971,493 | A * | 8/1934 | Leathers | A47L 9/06 15/369 |
| 2,086,124 | A | 7/1937 | Ell | |
| 2,157,077 | A | 5/1939 | Kroenlein | |
| 2,703,903 | A | 3/1955 | Faith-Ell | |
| 3,072,951 | A | 1/1963 | Kelnhofer | |
| 5,440,782 | A | 8/1995 | Yamashita | |
| 5,678,279 | A | 10/1997 | Gühne et al. | |
| 5,722,112 | A | 3/1998 | Scanni et al. | |
| 6,029,311 | A | 2/2000 | Scanni et al. | |
| 6,094,777 | A | 8/2000 | Windmeisser | |
| 8,424,157 | B2 | 4/2013 | Gell et al. | |
| 2004/0139993 | A1 | 7/2004 | Grey | |
| 2010/0236017 | A1 | 9/2010 | Krebs | |
| 2010/0306959 | A1 * | 12/2010 | Follows | A46B 13/005 15/383 |
| 2015/0223654 | A1 | 8/2015 | Ventress et al. | |
| 2015/0374185 | A1 | 12/2015 | Cole et al. | |

FOREIGN PATENT DOCUMENTS

| | | |
|---|---|---|
| DE | 950 233 | 10/1956 |
| DE | 1 503 919 | 11/1970 |
| DE | 203 13 203 | 11/2003 |
| EP | 0 264 625 | 4/1988 |
| EP | 0 786 228 | 7/1997 |
| EP | 1 832 214 | 9/2007 |
| FR | 1.102.148 | 10/1955 |
| FR | 1.584.025 | 12/1969 |
| GB | 519 | 11/1909 |
| GB | 185278 | 9/1922 |
| GB | 2 076 640 | 12/1981 |
| GB | 2 090 728 | 7/1982 |
| GB | 2 273 653 | 6/1994 |
| JP | 51-35064 | 9/1976 |
| JP | 52-15872 | 2/1977 |
| JP | 56-17043 | 7/1979 |
| JP | 58-190960 | 12/1983 |
| JP | 62-37256 | 3/1987 |
| JP | 5-317226 | 12/1993 |
| JP | 3001242 | 8/1994 |
| JP | 6-343585 | 12/1994 |
| JP | 7-241 | 1/1995 |
| JP | 7-37014 | 7/1995 |
| JP | 8-228975 | 9/1996 |
| JP | 10-248779 | 9/1998 |
| JP | 11-56714 | 3/1999 |
| JP | 2001-54495 | 2/2001 |
| JP | 2004-237127 | 8/2004 |
| JP | 2005-230514 | 9/2005 |
| JP | 2010-22515 | 2/2010 |
| WO | WO-00/65979 | 11/2000 |
| WO | WO-03/001958 | 1/2003 |

OTHER PUBLICATIONS

Ventress et al., Office Action dated Aug. 27, 2015, directed to U.S. Appl. No. 14/618,743; 7 pages.

* cited by examiner

VACUUM CLEANER TOOL

REFERENCE TO RELATED APPLICATIONS

This application is a national stage application under 35 USC 371 of International Application No. PCT/GB2014/050457, filed Feb. 17, 2014, which claims the priority of United Kingdom Application No. 1302905.3, filed Feb. 19, 2013, and United Kingdom Application No. 1302906.1, filed Feb. 19, 2013, the entire contents of which are incorporated herein by reference.

FIELD OF THE INVENTION

The present invention relates to a tool for a vacuum cleaner.

BACKGROUND OF THE INVENTION

FIGS. 1 and 2 illustrate a known type of vacuum cleaner tool 1. The tool 1 comprises a nozzle 2 having an elongate suction opening 3, and a strip of the bristles 4 that protrude through the suction opening 3. The tool 1 is intended to be swept from side-to-side in directions normal to the suction opening 3. As the tool 1 is swept forwards, the bristles 4 bend backwards and contact the trailing edge of the nozzle 2. The suction opening 3 is therefore located in front of the bristles 4 irrespective of the direction of travel.

A problem with the tool 1 is that there is a perceived need to improve the pickup performance of the tool 1.

SUMMARY OF THE INVENTION

The present invention therefore provides, in a first aspect, a tool for a vacuum cleaner, the tool comprising a nozzle and a bristle assembly, wherein the nozzle comprises an elongate suction opening delimited along its length by a leading edge and a trailing edge, the bristle assembly is mounted within the nozzle and protrudes through the suction opening, the bristle assembly comprises a carrier to which a strip of bristles is attached, the carrier is formed of a flexible material and protrudes beyond the suction opening such that the carrier is able to flex and contact the trailing edge.

By contacting the trailing edge, the carrier provides a better seal against the trailing edge than would otherwise be possible with the strips of bristles. Consequently, in contrast to the tool of FIGS. 1 and 2, the pickup performance of the tool is improved. The provision of a carrier has further advantages. For example, by attaching the bristles to a carrier that flexes, the bristles are required to bend through a smaller angle. The bristles are therefore subjected to smaller stresses, thus improving the longevity of the bristles. Additionally, the bristles are better able to retain their shape. The carrier also provides support for the bristles. As a result, finer bristles may be used that might otherwise be drawn into the nozzle by the suction generated at the suction opening. The suction decreases markedly just beyond the suction opening owing to the sudden expansion in available volume. Since the carrier protrudes beyond the suction opening, the suction experienced by the bristles is much reduced and thus particularly soft and fine bristles may be used.

The carrier may flex and contact the trailing edge when the tool is swept over a cleaning surface in a first direction, and the carrier may flex and contact the leading edge when the tool is swept over the cleaning surface in a second opposite direction. This then has the advantage that the carrier forms a seal against an edge of the nozzle when the tool is swept both forwards and backwards over the cleaning surface.

When the carrier flexes and contacts the trailing edge, a partial vacuum is typically created on the trailing side of the bristle assembly. This partial vacuum may be sufficiently strong that, when the tool is lifted from the cleaning surface (e.g. in order to reverse the direction of travel), the bristle assembly may remain stuck against the trailing edge. In order to address this, the carrier may comprise one or more through-holes. The through-holes provide passageways between the leading side and the trailing side of the bristle assembly. As a result, the pressure difference on the two sides of the bristle assembly is reduced and thus the bristle assembly is less likely to stick against the trailing edge.

An alternative problem with the tool 1 of FIGS. 1 and 2 is that the suction generated by the vacuum cleaner can cause the bristles 4 to become stuck against the trailing edge.

The present invention therefore provides, in a second aspect, a tool for a vacuum cleaner, the tool comprising a nozzle and a bristle assembly, wherein the nozzle comprises an elongate suction opening, the bristle assembly is mounted within the nozzle and protrudes through the suction opening, the bristle assembly comprises a strip of bristles attached to a carrier, and the carrier is arranged to pivot or flex relative to the nozzle and comprises one or more through-holes.

As the tool is swept forwards over the cleaning surface, the carrier pivots or flexes such that the bristle assembly is swept backwards. A seal is then created between the bristle assembly and a trailing edge of the nozzle. As a result, a partial vacuum is created on the trailing side of the bristle assembly. With the tool of FIGS. 1 and 2, this partial vacuum may be sufficiently strong that, when the tool is lifted from the cleaning surface (e.g. in order to reverse the direction of travel), the bristles remain stuck against the trailing edge. With the tool of the present invention, the through-holes provide passageways between the leading side and the trailing side of the bristle assembly. The through-holes act to better equalise the pressure on the two sides of the bristle assembly. The equalisation provided by the through-holes may not be perfect. However, the pressure difference on the two sides of the bristle assembly is reduced and thus the bristle assembly is less likely to stick against the trailing edge. Indeed, the pressure difference may be reduced to such an extent that, when the tool is lifted from the cleaning surface, the bristle assembly returns to the central position.

The suction opening may be delimited along its length by a leading edge and a trailing edge, and the carrier may extend beyond the suction opening by an amount that permits the carrier to pivot or flex and contact the trailing edge. By contacting the trailing edge, the carrier provides a better seal against the trailing edge than would otherwise be possible with the strips of bristles. Consequently, in contrast to the tool of FIGS. 1 and 2, the pickup performance of the tool is improved. The provision of a carrier has further advantages. For example, by attaching the bristles to a carrier that pivots or flexes, the bristles are required to bend through a smaller angle. The bristles are therefore subjected to smaller stresses, thus improving the longevity of the bristles. Additionally, the bristles are better able to retain their shape. The carrier also provides support for the bristles. As a result, finer bristles may be used that might otherwise be drawn into the nozzle by the suction generated at the suction opening. The suction decreases markedly just beyond the suction opening owing to the sudden expansion in available volume. Since the carrier protrudes beyond the suction opening, the suction experienced by the bristles is much reduced and thus particularly soft and fine bristles may be used.

The carrier may pivot or flex and contact the trailing edge when the tool is swept over a cleaning surface in a first direction, and the carrier may pivot or flex and contact the leading edge when the tool is swept over the cleaning surface in a second opposite direction. This then has the advantage that the carrier forms a seal against an edge of the nozzle when the tool is swept both forwards and backwards over the cleaning surface.

The following paragraphs apply equally to both aspects of the present invention.

The tool may comprise a duct for attachment to a wand, hose or the like of the vacuum cleaner, the suction opening may extend from a front to a rear of the nozzle, and the duct may be attached to the rear of nozzle. The through-holes are then formed in a region of the carrier proximate the rear of the nozzle. Since the duct is located at the rear of the nozzle, the suction within the nozzle will be greatest at the rear of the nozzle. Any pressure difference between the leading and trailing sides of the bristle assembly is therefore likely to be greatest at the rear of the nozzle. By ensuring that the through-holes are formed in a region of the carrier proximate the rear of the nozzle, better equalisation of pressure may be achieved where it is needed most.

The carrier may comprise through-holes of different sizes. As a result, better equalisation of pressure may be achieved whilst minimising the effect that the through-holes have on the behaviour of the carrier. For example, where the suction opening extends from a front to a rear of the nozzle and the tool comprises a duct attached to the rear of nozzle, the carrier may comprise a first through-hole and a second through-hole, the first through-hole being larger and located closer to the rear of the nozzle.

The bristle assembly may be attached along a top of the nozzle. Consequently, fluff and other dirt are prevented from becoming trapped between the bristle assembly and the top of the nozzle. In contrast, with the tool of FIGS. 1 and 2, fluff and other dirt may become trapped between the bristles and the top of the nozzle. Additionally, the top of the nozzle is able to provide a support for the bristle assembly. As a result, the bristle assembly is prevented from bending upwards during use, e.g. due to the suction generated within the nozzle or when swept over an uneven surface.

The tool may comprise a duct for attachment to a wand, hose or the like of the vacuum cleaner, the suction opening may extend from a front to a rear of the nozzle, and the duct may be attached to the rear of nozzle. The height or width of the nozzle may then taper from the rear to the front of the nozzle. If the nozzle were of uniform height and width, the suction generated at the suction opening would be greater at the rear of the nozzle than at the front of the nozzle. This would then have two potentially adverse consequences. This would then have two potentially adverse consequences. First, the suction would be weaker at the front of the suction opening and thus pickup would be poorer at the front of the nozzle. Second, the suction at the rear of the suction opening may be sufficiently strong that it causes the ends of the bristles to be drawn into the nozzle. By tapering the height and/or width of the nozzle, a larger open volume is created within the nozzle at the rear, and a smaller open volume is created at the front. As a result, the suction is better balanced along the length of the suction opening.

The carrier may be formed of rubber. Moreover, the rubber may be overmoulded onto the bristles.

The bristles may be formed of carbon fibre. A strip of bristles has the advantage that no streaks of dirt are left behind as the tool is swept over the cleaning surface. Carbon fibre has at least two advantages. First, carbon fibre allows for relatively soft and fine bristles to be used, which help reduce marking of the cleaning surface. Second, carbon fibre has good anti-static properties, which means that the bristles can be swept over the cleaning surface without charging the surface. In contrast, nylon bristles tend to charge the cleaning surface and the resulting static then acts to attract dirt to the cleaning surface.

BRIEF DESCRIPTION OF THE DRAWINGS

In order that the present invention may be more readily understood, embodiments of the invention will now be described, by way of example, with reference to the accompanying drawings, in which.

DETAILED DESCRIPTION OF THE INVENTION

Figure 1:
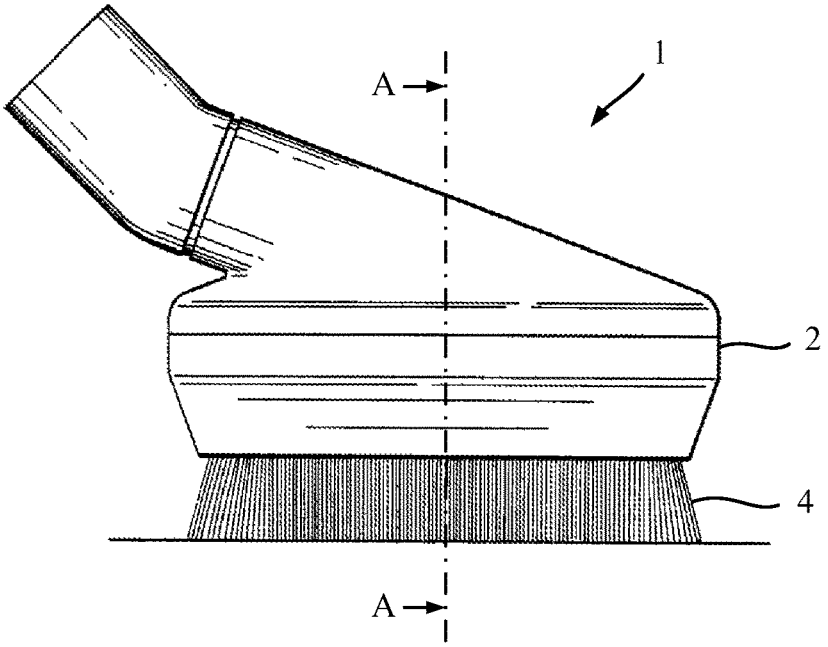
Fig. 1 (Prior Art)
FIG. 1 is a side view of a known type of vacuum cleaner tool.

The vacuum cleaner tool 10 of FIGS. 3 to 8 comprises a nozzle 11, a connecting duct 12, and a bristle assembly 13.

The nozzle 11 is a relatively narrow structure, with the width of the nozzle 11 being much smaller than the length of the nozzle 11. The height of the nozzle 11 tapers (i.e. decreases gradually) from the rear 16 to the front 15 of the nozzle 11, the advantages of which are explained below. The nozzle 11 comprises a suction opening 20 that opens up into an internal cavity 21 within the nozzle 11. The suction opening 20 is located in the base of the nozzle 11 and extends centrally from the front 15 to the rear 16 of the nozzle 11. The suction opening 20 is delimited along its length by two edges 22,23 of the nozzle 11. Each edge 22,23 is raised relative to the lower ends 17,18 of the front 15 and the rear 16 of the nozzle 11. Consequently, when the base of the nozzle 11 is brought into contact with a cleaning surface 40, a gap 25 is created between each of the edges 22,23 and the cleaning surface 40. Again, the advantages of this are explained below.

The connecting duct 12 is attached to the rear 16 of the nozzle 11 and is in fluid communication with the cavity 21 and thus the suction opening 20 of the nozzle 11. The connecting duct 12 is intended to be attached to a hose, wand or the like of a vacuum cleaner (not shown). During use, the vacuum cleaner generates suction at the connecting duct 12, causing air to be drawn in through the suction opening 20.

The bristle assembly 13 is generally planar in shape and comprises a carrier 30 to which a strip of bristles 31 and a spine 32 are attached.

The carrier 30 is formed of a flexible material such as rubber. The bottom of the carrier 30 rises relative to the top in a direction from the rear to the front of the carrier 30. As a result, the height of the carrier 30 tapers (i.e. decreases gradually) from the rear 37 to the front 36 of the carrier 30.

The bristles 31 are formed of carbon fibre and extend beyond the bottom of the carrier 30. The bristles 31 are attached to the carrier 30 by moulding the carrier 30 over the upper ends of the bristles 31. However, the bristles 31 could conceivably be attached to the carrier 30 by other means. The lengths of the bristles 31 taper (i.e. decrease gradually) from the front to the rear of the carrier 30. Consequently, the lengths of the bristles 31 at the rear of the carrier 30 are shorter than those at the front.

The spine 32 is formed of a rigid material, such as hard plastic, and is attached along the top of the carrier 30. The spine 32 provides structural support for the carrier 30, as well as providing means for attaching the bristle assembly 13 to the nozzle 11.

The bristle assembly 13 is mounted within the cavity 21 of the nozzle 11 such that the carrier 30 and the bristles 31 protrude through the suction opening 20. More specifically, the front 15 and the rear 16 of the nozzle 11 each include a recess into which the ends of the spine 32 are secured. The bristle assembly 13 is mounted within the cavity 21 such that the taller part of the carrier 30 and the shorter bristles 31 are located at the rear of the suction opening 20.

The tool 10 is intended to be swept across a cleaning surface 40 in directions normal to the suction opening 20. As the tool 10 is swept forwards, the bristle assembly 13 flexes backwards. The suction opening 20 is then located wholly in front of the bristles 31. The bristles 31 create a partial seal with the cleaning surface 40, which then improves the suction that is generated in front of the bristles 31. As the tool 10 is swept over the cleaning surface 40, the suction generated in front of the bristles 31 causes dirt to be drawn into the cavity 21 of the nozzle 11 via the suction opening 20. Thereafter, the dirt is carried to the vacuum cleaner via the connecting duct 12. The bristles 31 act to pick up much of the dirt that is not drawn into the nozzle 11. The bristles 31 then hold on to the dirt until such time as the dirt is drawn into the nozzle 11, e.g. when the tool 10 is lifted from the cleaning surface 40 or when the direction of travel of the tool 10 is reversed.

Figure 8:
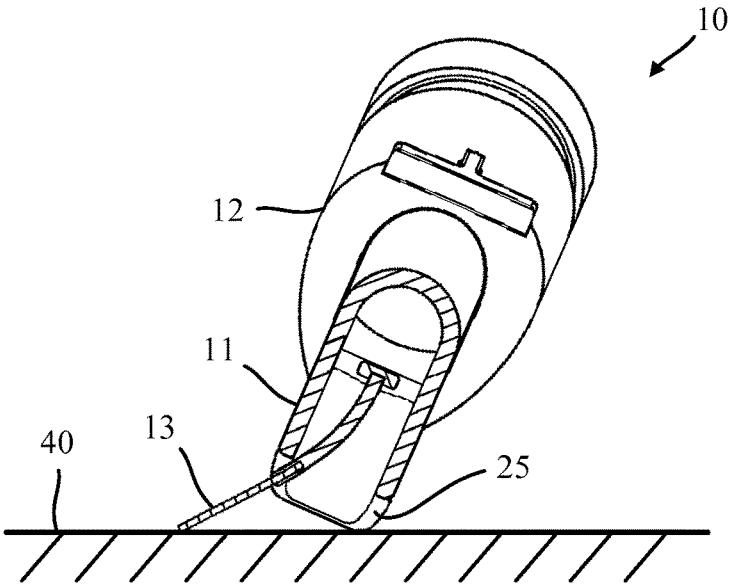
FIG. 8 is a sectional view through the tool of FIG. 3 as the tool is swept across a surface, the section being taken in the plane B-B.
Figure 9:
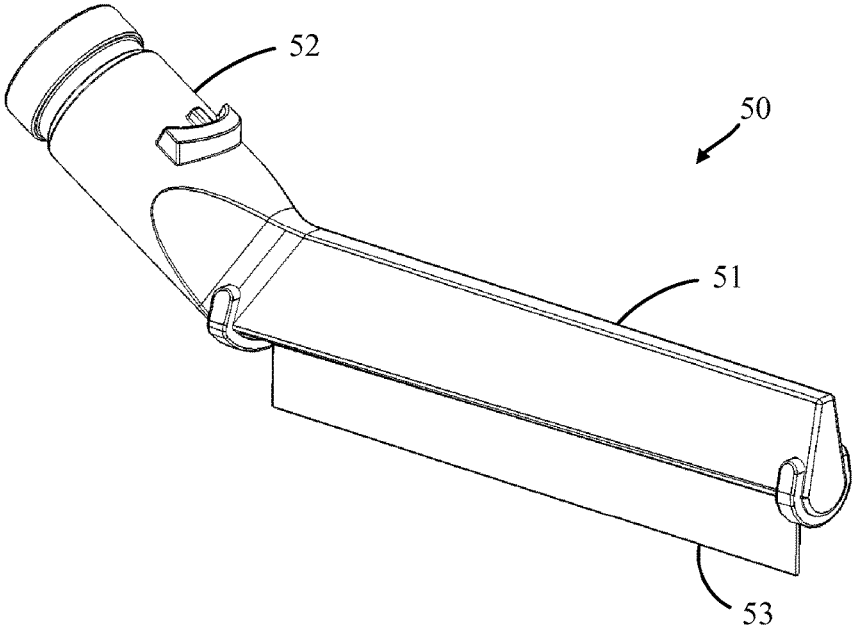
FIG. 9 is a perspective view of a second vacuum cleaner tool in accordance with the present invention.
Figure 10:
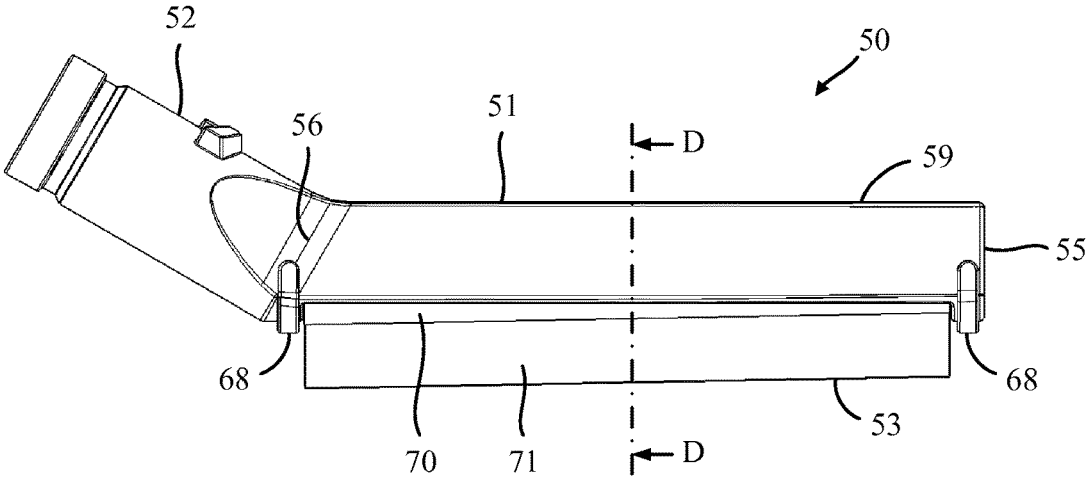
FIG. 10 is a side view of the tool of FIG. 9.
Figure 11:
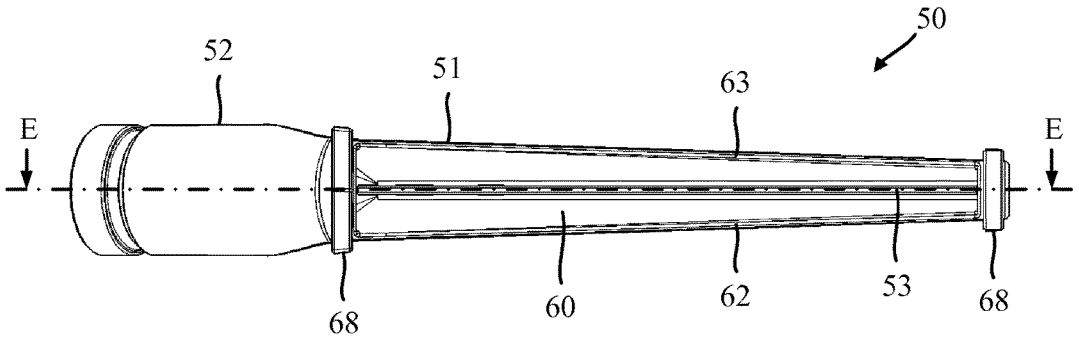
FIG. 11 is an underside view of the tool of FIG. 9.
Figure 12:
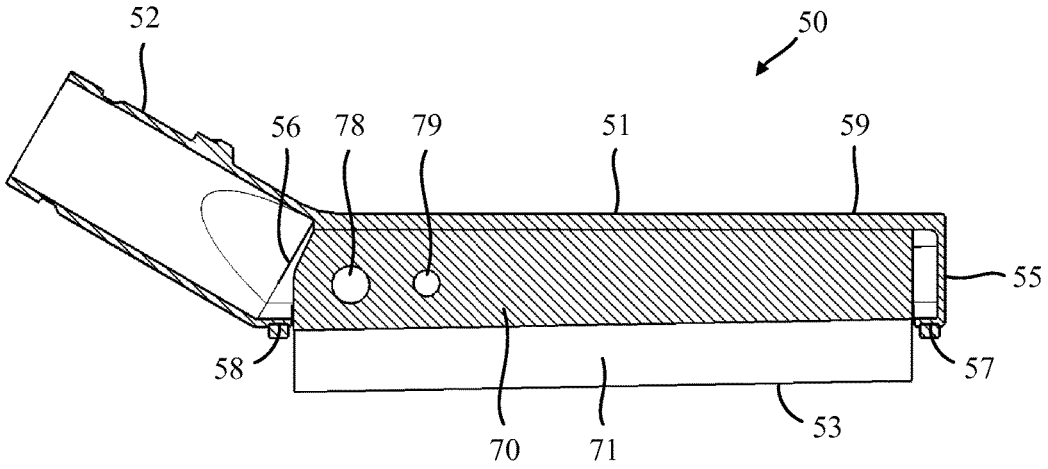
FIG. 12 is a sectional view through the tool of FIG. 9, the section being taken in the plane E-E indicated in FIG. 11.
Figure 13:
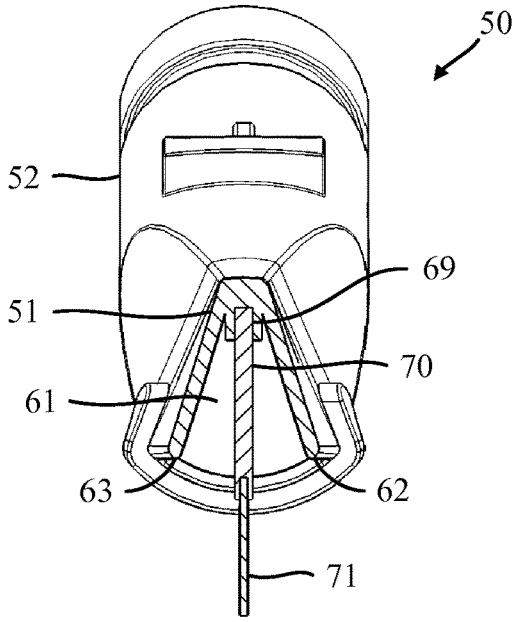
FIG. 13 is a sectional view through the tool of FIG. 9, the section being taken in the plane D-D indicated in FIG. 10.
Figure 14:
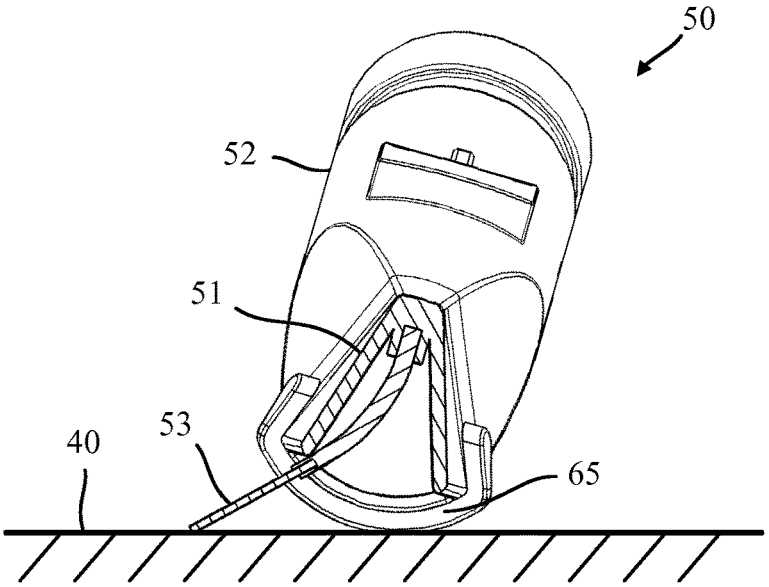
FIG. 14 is a sectional view through the tool of FIG. 9 as the tool is swept across a surface, the section being taken in the plane D-D.

As the tool 10 is swept over the cleaning surface 40, the front 15 and the rear 16 of the nozzle 11 make contact with the cleaning surface 40. Of the two edges 22,23 that delimit the length of the suction opening 20, one defines a leading edge 22 of the nozzle 11 and the other defines a trailing edge 23. Since the two edges 22,23 are raised relative to the front 15 and rear 16 of the nozzle 11, a gap 25 is created between the leading edge 22 of the nozzle 11 and the cleaning surface 40. This gap 25 ensures that, as the tool 10 is swept over the cleaning surface 40, dirt is able to pass under the leading edge 22. As a result, the tool 10 does not push the dirt over the cleaning surface 40. During use, a user will typically tilt the tool 10 in the direction of travel such that an acute angle is formed between the nozzle 11 and the cleaning surface 40, as shown in FIG. 8. As a consequence of tilting the nozzle 11, the leading edge 22 is brought closer to the cleaning surface 40. Nevertheless, the gap 25 between the leading edge 22 and the cleaning surface 40 is maintained. As the tool 10 is tilted further forwards, the gap 25 between the leading edge 22 and the cleaning surface 40 decreases. Eventually, with sufficient tilting, the leading edge 22 may contact the cleaning surface 40. At this stage, the nozzle 11 would then start to push dirt along the cleaning surface 40. This problem may be mitigated by further raising the edges 22,23 of the nozzle 11 such that a larger nominal gap 25 is created between the leading edge 22 and the cleaning surface 40. However, a larger gap 25 has the disadvantage that more air is likely to be pulled in from the region above the cleaning surface 40 rather than at the cleaning surface 40 and thus pickup performance is adversely affected. The edges 22,23 are therefore raised by an amount which seeks to balance the need to maintain a relatively small gap 25 with the need to maintain a gap 25 over the range of angles through which the tool 10 is likely to be used.

The spine 32 provides structural support along the top 35 of the carrier 30. This then helps prevent the carrier 30 from flexing upwards during use of the tool 10, e.g. as a result of the suction generated within the nozzle 11 or when the tool 10 is swept over an uneven surface.

Employing a strip of bristles 31 has the advantage that streaks of dirt are not left behind as the tool 10 is swept over the cleaning surface 40. The choice of carbon fibre has at least two advantages. First, carbon fibre enables relatively soft and fine bristles 31 to be used, which then helps to reduce marking of the cleaning surface 40. Second, carbon fibre has good anti-static properties. Consequently, as the bristles 31 are swept over the cleaning surface 40, the bristles 31 do not charge the cleaning surface 40. In contrast, nylon bristles tend to charge the cleaning surface, and the resulting static then acts to attract dirt to the cleaning surface.

Although advantageous, employing soft, fine bristles is not without its difficulties. In particular, if such bristles were employed with the tool 1 of FIGS. 1 and 2, the suction generated at the suction opening 3 would most likely to draw the bristles 4 into the nozzle 2. The tool 10 of FIGS. 3 to 8 has several features that help to prevent this from happening.

First, the lengths of the bristles 31 taper from the front to the rear of the suction opening 20. Consequently, the bristles 31 at the rear of the suction opening 20 are shorter than those at the front. Longer bristles have the advantage that they are more flexible and thus less likely to mark the cleaning surface 40. Additionally, longer bristles are better able to penetrate awkward surfaces and thus improve pickup performance. It would therefore be advantageous to employ longer bristles along the full length of the suction opening 20. However, if longer bristles are employed along the full length of the suction opening 20 then the bristles 31 at the rear of the suction opening 20 may be drawn up into the nozzle 10. This is because the suction generated at the suction opening 20 is generally greatest at the rear of the suction opening 20 due to the location of the connecting duct 12. By employing shorter bristles 31 at the rear of the suction opening 20, the bristles 31 are stiffer and thus less likely to be drawn up into the nozzle 11. Conversely, by employing longer bristles 31 at the front of the suction opening 20, the bristles 31 are better able to penetrate awkward surfaces and thus improve pickup. The suction at the suction opening 20 typically decreases along the length of the suction opening 20. Accordingly, by having bristles 31 that taper in length along the length of the suction opening 20, relatively good pickup may be achieved whilst ensuring that the bristles 31 are of sufficient length to prevent them being drawn into the nozzle 11.

Second, the bristles 31 are attached to a carrier 30 which provides support for the bristles 31. Additionally, the carrier 30 protrudes beyond the suction opening 20. The suction experienced by the bristle assembly 13 decreases markedly just beyond the suction opening 20 owing to the sudden expansion in available volume. Since the carrier 30 protrudes beyond the suction opening 20, the suction experienced by the bristles 31 is much reduced and thus relatively soft and fine bristles may be used. In contrast, with the tool 1 of FIGS. 1 and 2, the bristles 4 are unsupported and extend through the suction opening 3 and into the cavity of the nozzle 2. As a result, the bristles 4 are subjected to higher levels of suction and thus stiffer bristles 4 must be used in order to ensure that the bristles 4 are not drawn into the nozzle 11. The carrier 30 is not of uniform height but is instead taller at the rear of the suction opening 20. As noted in the preceding paragraph, the suction generated at the suction opening 20 is generally greatest at the rear of the suction opening 20. By employing a carrier 30 that is taller at the rear of the suction opening 20, the carrier 30 provides additional rigidity and support to the bristles 31 where it is needed most.

Third, the height of the nozzle 11 tapers from the rear 16 to the front 15 of the nozzle 11. If the nozzle 11 were of uniform height, the suction generated at the suction opening 20 would be much greater at the rear than at the front of the suction opening 20. This follows since the connecting duct 12 is located at the rear of the nozzle 11. The increased suction at the rear of the suction opening 20 might then cause the bristles 31 to be drawn into the nozzle 11. Additionally, the suction and thus the pickup performance at the front of the suction opening 20 would be poorer. By tapering the height of the nozzle 11, the volume of the cavity 21 within the nozzle 11 also tapers from the rear 16 to the front 15 of the nozzle 11. A larger open volume is therefore created within the nozzle 11 at the rear of the suction opening 20, and a smaller open volume is created at the front of the suction opening 20. The suction is therefore better balanced along the length of the suction opening 20. As result, softer, finer bristles may be used at the rear of the suction opening 20, and the pickup performance at the front of the suction opening 20 may be improved.

Figure 2:
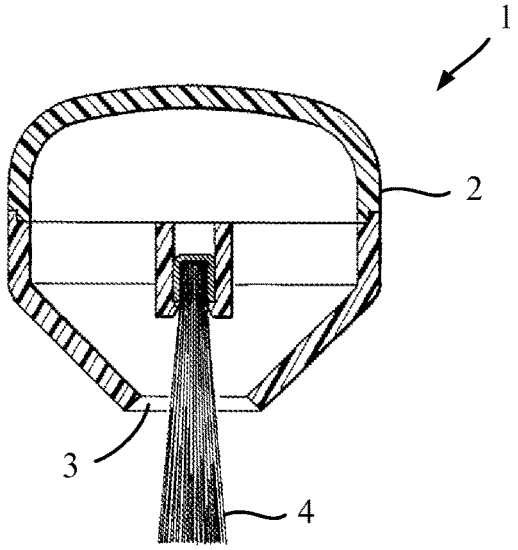
Fig. 2 (Prior Art)
FIG. 2 is a sectional view through the tool of FIG. 1, the section being taken in the plane A-A.
Figure 3:
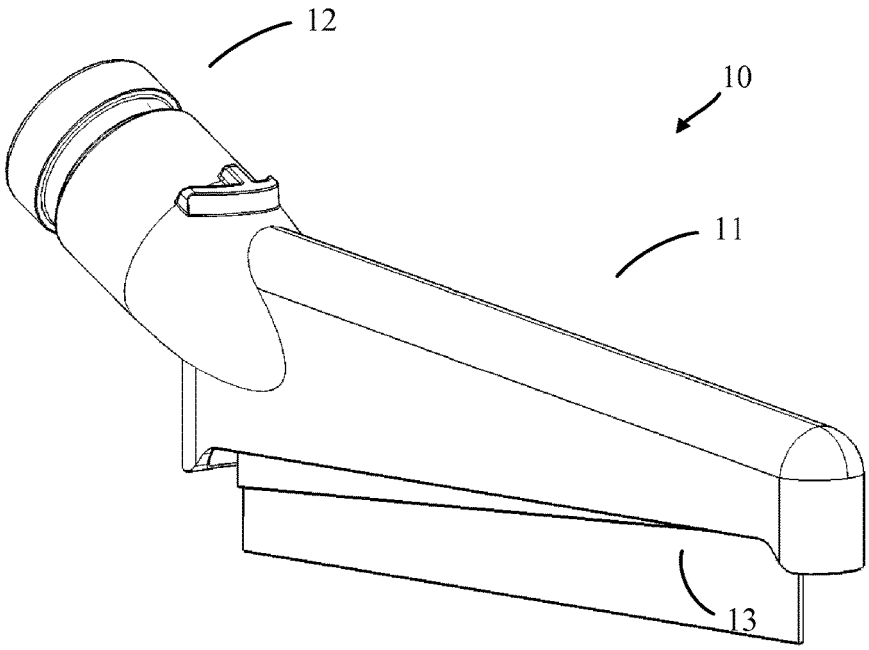
FIG. 3 is a perspective view of a first vacuum cleaner tool in accordance with the present invention.
Figure 4:
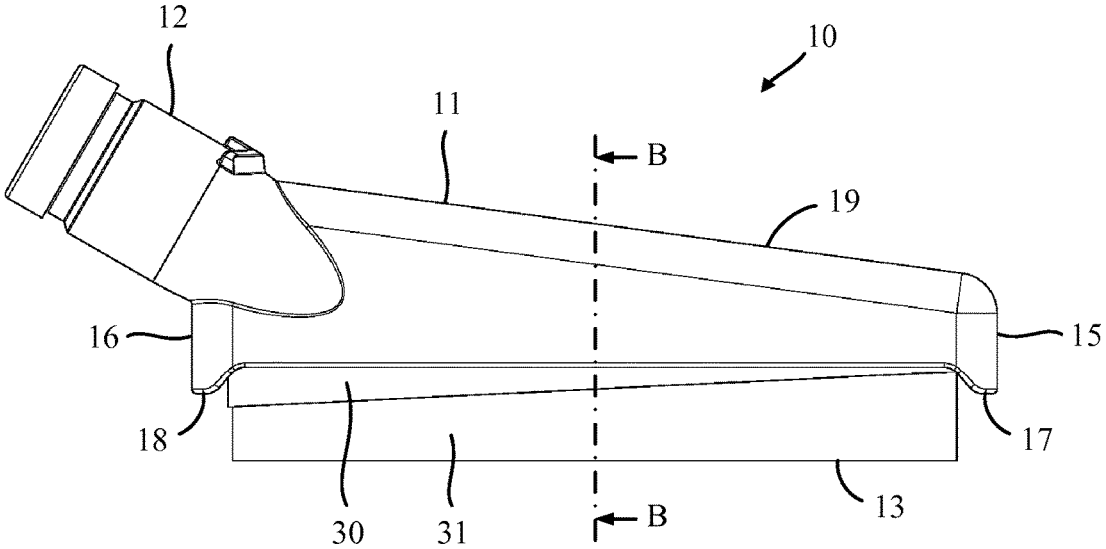
FIG. 4 is a side view of the tool of FIG. 3.
Figure 5:
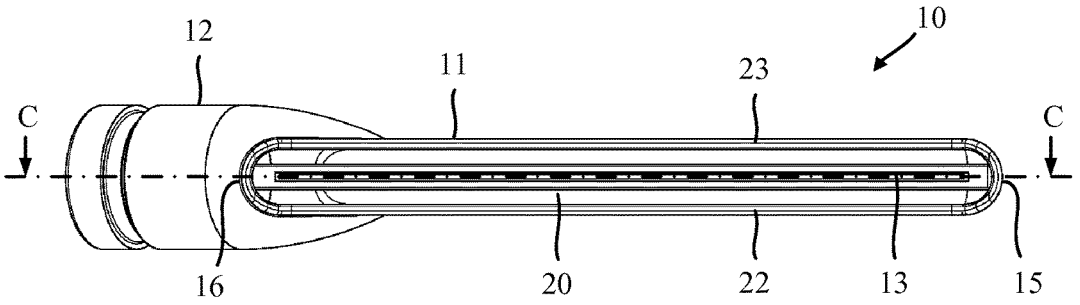
FIG. 5 is an underside view of the tool of FIG. 3.
Figure 6:
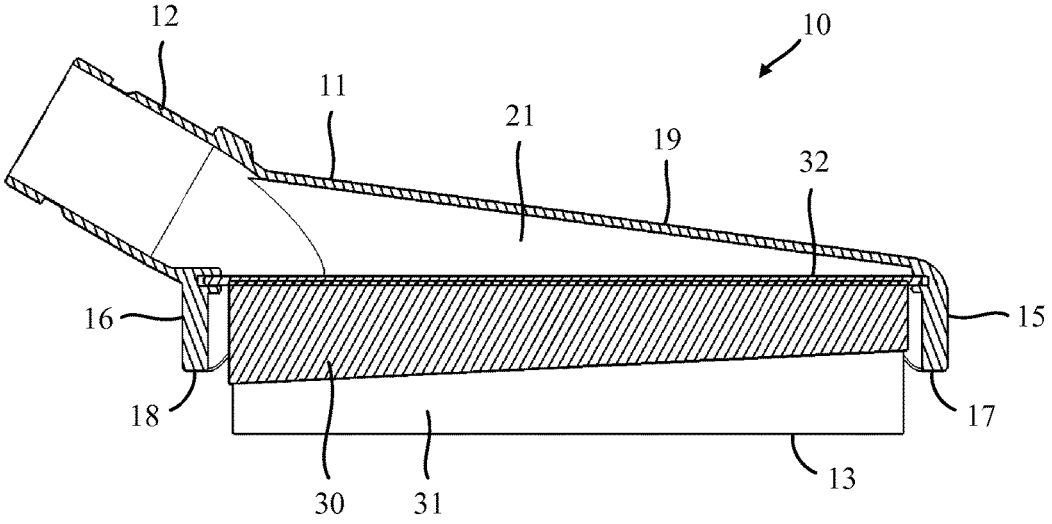
FIG. 6 is a sectional view through the tool of FIG. 3, the section being taken in the plane C-C indicated in FIG. 5.
Figure 7:
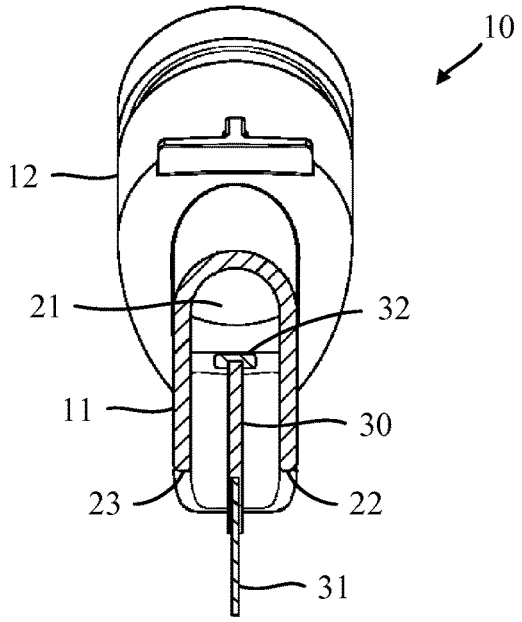
FIG. 7 is a sectional view through the tool of FIG. 3, the section being taken in the plane B-B indicated in FIG. 4.

The carrier 30, being formed of a flexible material, flexes relative to the nozzle 11 as the tool 10 is swept over the cleaning surface 40. As a result, the bristles 31 are required to bend through a smaller angle. The bristles 31 are therefore subjected to smaller stresses, thus improving the longevity of the bristles 31. Additionally, the bristles 31 are better able to retain their shape. In contrast, the bristles 4 of the tool 1 of FIGS. 1 and 2 are subjected to higher bending stresses. Rather than employing a flexible carrier 30, the bristle assembly 13 could conceivably comprise a carrier formed of a rigid material. The bristle assembly 13 might then be pivotally attached to the nozzle 11 and, if required, a spring mechanism might be used to ensure that the carrier returns to a central position when the tool 10 is lifted from the cleaning surface 40.

The carrier 30 protrudes beyond the suction opening 20 by an amount that ensures that, when the bristle assembly 13 is swept backwards (e.g. during a forward sweep of the tool 10), the carrier 30 contacts the trailing edge 23. More specifically, the carrier 30 contacts the trailing edge 23 along the full length of the carrier 30. By contacting the trailing edge 23, the carrier 30 provides a better seal against the trailing edge 23 of the nozzle 11 than would otherwise be possible with the bristles 31. Consequently, less air is pulled in through the trailing side of the tool 10 and thus more suction is generated in front of the bristles 31, thereby improving pickup.

FIGS. 9 to 14 illustrate an alternative vacuum cleaner tool 50 that is similar in many respects to that described above and illustrated in FIGS. 3 to 8. In particular, the tool 50 comprises a nozzle 51, a connecting duct 52, and a bristle assembly 53.

The nozzle 51 is somewhat different in shape to that of FIGS. 3 to 8. The nozzle 11 of FIGS. 3 to 8 has a cross-sectional shape that is generally rectangular. In contrast, the cross-sectional shape of the nozzle 51 of FIGS. 9 to 14 is generally triangular. Accordingly, the shape of the nozzle 51 may be regarded as an elongate prism. The width of the nozzle 11 of FIGS. 3 to 8 is constant along the length of the nozzle 11, whilst the height of the nozzle 11 tapers from the rear 16 to the front 15 of the nozzle 11. In contrast, the height of the nozzle 51 of FIGS. 9 to 14 is constant, and the width of the nozzle 51 tapers (i.e. decreases gradually) from the rear 56 to the front 55 of the nozzle 51.

The nozzle 51, like that of FIGS. 3 to 8, comprises a suction opening 60 that opens up into an internal cavity 61 within the nozzle 51. The suction opening 60 is again located in the base of the nozzle 61 and extends centrally from the front 55 to the rear 56 of the nozzle 51. In contrast to the nozzle 11 of FIGS. 3 to 8, the suction opening 60 is not of uniform width. Instead, the width of the suction opening 60 tapers (i.e. decreases gradually) from the rear to the front of the suction opening 60, the benefits of which are explained below. The suction opening 60 is again delimited along its length by two edges 62,63 of the nozzle 51 that are raised relative to the front 55 and the rear 56 of the nozzle 51. Consequently, when the base of the nozzle 51 is brought into contact with the cleaning surface 40, a gap 65 is created between the leading edge 62 and the cleaning surface 40. The lower ends 57,58 of the front 55 and rear 56 of the nozzle 51 are curved. Furthermore, the lower ends 57,58 are each covered with a protective pad 68 formed of a tufted fabric, the benefits of which are explained below.

The connecting duct 52 is essentially unchanged from that of FIGS. 3 to 8. In particular, the connecting duct 52 is attached to the rear 56 of the nozzle 51 and is intended to be attached to a hose, wand or the like of a vacuum cleaner (again, not shown).

The bristle assembly 53 is again generally planar in shape and comprises a carrier 70 to which a strip of bristles 71 is attached.

The carrier 70 is formed of a flexible material, such as rubber, and the bottom of the carrier 70 rises relative to the top in a direction from the rear to the front of the carrier 70. As a result, the height of the carrier 70 again tapers from the rear to the front of the carrier 70. In contrast to the carrier 30 of FIGS. 3 to 8, the carrier 70 comprises a pair of through-holes 78,79 located towards the rear of the carrier 70. The through-holes 78,79 have different sizes, with the through-hole 78 closest to the rear of the carrier 70 being larger.

The bristles 71 are again formed of carbon fibre and extend beyond the bottom of the carrier 70. However, unlike the bristles 31 of FIGS. 3 to 8, the lengths of the bristles 71 do not taper. Instead, the lengths of the bristles 71 are constant from the rear to the front of the carrier 70.

The bristle assembly 53 is mounted within the cavity 61 of the nozzle 51 such that the carrier 70 and the bristles 71 protrude through the suction opening 60. In contrast, to the bristle assembly 13 of FIGS. 3 to 8 which is attached to the front 15 and rear 16 of the nozzle 11, the bristle assembly 71 of FIGS. 9 to 14 is attached to the top 59 of the nozzle 51. In particular, the top of the carrier 70 is secured (e.g. by means of an adhesive) within a groove 69 formed along the top 59 of the nozzle 51. The bristle assembly 13 of FIGS. 3 to 8 includes a spine 32 that provides structural support along the top 35 of the carrier 30. Since the bristle assembly 53 of FIGS. 9 to 14 is attached along the top 59 of the nozzle 51, the spine may be omitted and the top 59 of the nozzle 51 may provide the necessary support. That being said, there may be advantages in employing a spine. For example, the bristle assembly 53 may comprise a spine that snaps into a groove in the top 59 of the nozzle 51. This then has the potential advantage of simplifying the assembly of the tool 50. In particular, the use of an adhesive to secure the bristle assembly 53 to the nozzle 51 may be avoided.

With the tool 10 of FIGS. 3 to 8, the bristle assembly 13 protrudes beyond the suction opening 20 by an amount that is constant along the length of the suction opening 20. In contrast, with the tool 50 of FIGS. 9 to 14, the amount by which the bristle assembly 53 protrudes beyond the suction opening 60 tapers (i.e. decreases gradually) from the rear to the front of the suction opening 60. Consequently, the amount by which the bristle assembly 53 protrudes beyond the suction opening 60 is greater at the rear of the suction opening 60 than at the front of the suction opening 60.

The tool 50 of FIGS. 9 to 14 is intended to be used in exactly the same way as that described above in connection with the tool 10 of FIGS. 3 to 8. In particular, the tool 50 is intended to be swept across the cleaning surface 40 in directions normal to the suction opening 60. As the tool 50 is swept forwards, the bristle assembly 53 flexes backwards such that the suction opening 60 is located wholly in front of the bristles 71. The bristle assembly 53 contacts the cleaning surface 40 and the trailing edge 63 of the nozzle 51 so as to create a seal behind the suction opening 60.

As the tool 50 is swept over the cleaning surface 40, the front 55 and the rear 56 of the nozzle 51 make contact with the cleaning surface 40. Since the leading and trailing edges 62,63 of the nozzle 51 are raised relative to the front 55 and rear 56, a gap 65 is again created between the leading edge 62 and the cleaning surface 40, thus ensuring that dirt is free to pass under the leading edge 62.

The angle formed between the tool 50 and the cleaning surface 40 typically changes as the tool 50 is swept across the cleaning surface 40. For example, the user may start with the tool 50 at an acute angle relative to the cleaning surface 40. As the tool 50 is swept across the cleaning surface 40, the tool 50 gradually straightens, perhaps finishing at an obtuse angle. The lower ends 57,58 of the nozzle 51 that contact the cleaning surface 40 are curved. This then has the advantage that, as the angle of the tool 50 changes, the lower ends 57,58 of the nozzle 51 rock over the cleaning surface 40 so as to provide a smooth transition. Moreover, the lower ends 57,58 of the nozzle 51 are each covered with a protective pad 68. This has two benefits. First, the pads 68 have a lower coefficient of friction than that of the nozzle 51 and thus the tool 60 may be swept over the cleaning surface 40 more smoothly and with less effort. Second, the pads 68 are softer than the nozzle 51 and thus the tool 60 is less likely to mark the cleaning surface 40. In the present embodiment, the pads 68 are each formed of a tufted fabric. However, the pads 68 might equally be formed of a different material that is softer and has a lower coefficient of friction than that of the nozzle 51. By way of example only, the pads 68 may be formed of a felted fabric, an elastomeric foam perhaps having a low-friction coating such as PTFE, or a strip of very short and fine bristles.

As with the tool 10 of FIGS. 3 to 8, the tool 50 of FIGS. 9 to 14 has several features that help prevent the bristles 71 from being drawn into the nozzle 51.

First, the bristles 71 are again attached to a carrier 70, which provides support for the bristles 71. As with the tool 10 of FIGS. 3 to 8, the connecting duct 52 is attached to the rear 56 of the nozzle 51 and thus the suction is generally greatest at the rear of the suction opening 60. The carrier 70 is again taller at the rear of the suction opening 60. As a result, the carrier 70 provides additional rigidity and support to the bristles 71 where it is needed most. The carrier 70 also protrudes beyond the suction opening 60, and thus the suction experienced by the bristles 71 is much reduced.

Second, the width of the suction opening 60 tapers from the rear to the front of the suction opening 60. If the width of the suction opening 60 were uniform, the suction at the rear of the suction opening 60 would be significantly higher than that at the front of the suction opening 60. The higher level of suction at the rear may cause the bristles 71 to be drawn into the nozzle 51. By employing a suction opening 60 that is wider at the rear and narrower at the front, the suction along the length of the suction opening 60 is better balanced. In particular, the suction at the rear of the suction opening 60 is reduced so as to prevent the bristles 71 being drawn into the nozzle 51, whilst the suction at the front of the suction opening 60 is increased so as to improve pickup.

Third, the width of the nozzle 51 tapers from the rear 56 to the front 55 of the nozzle 51. This has the same benefit as tapering the height of the nozzle 11 of FIGS. 3 to 8, namely that the volume of the cavity 61 within the nozzle 51 decreases from the rear 56 to the front 55 of the nozzle 51. A larger open volume is therefore created within the nozzle 51 at the rear of the suction opening 60, and a smaller open volume is created at the front of the suction opening 60. The suction is therefore better balanced along the length of the suction opening 60. As result, softer, finer bristles 71 may be used at the rear of the suction opening 60, whilst the pickup performance at the front of the suction opening 60 may be improved. Tapering the width rather than the height of the nozzle 51 has the additional benefit that a relatively low profile may be achieved for the tool 50. In particular, the height of the tool may be kept relatively low and the required change in the volume of the cavity 61 may be achieved through changes in the width of the nozzle 51. As a result, the tool 51 may be used to clean under spaces of relatively low height.

As with the tool 10 of FIGS. 3 to 8, the carrier 70 protrudes beyond the suction opening 60 by an amount that ensures that, when the bristle assembly 53 is swept backwards (e.g. during a forward sweep of the tool 50), the carrier 70 contacts the trailing edge 63 of the nozzle 51. As noted above, this then ensures that a better seal is formed between the bristle assembly 53 and the trailing edge 63 of the nozzle 51. The width of the suction opening 60 tapers from the rear 56 to the front 55 of the nozzle 51. Accordingly, in order that the carrier 70 contacts the trailing edge 63 along the full length of the carrier 70, the amount by which the carrier 70 protrudes beyond the suction opening 60 also tapers from the rear to the front. The bristles 71, however, do not taper but are instead of constant length. This then has the advantage that longer bristles may be employed at the rear of the suction opening 60. Additionally, bristles of constant length ensure that, when the bristle assembly 53 is swept backwards and the carrier 70 contacts the trailing edge 63, the bristles 71 extend beyond the trailing edge 63 by an amount that is constant along the length of the trailing edge 63. This then has the benefit of providing more even pickup along the length of the nozzle 51. Since the height of the carrier 70 tapers but the lengths of the bristles 71 are constant, the bristle assembly 53 protrudes beyond the suction opening 60 by an amount that tapers from the rear to the front of the suction opening 60. This is in contrast to the tool 10 of FIGS. 3 to 8, in which the bristle assembly 13 protrudes by the same amount along the length of the suction opening 20.

With the tool 10 of FIGS. 3 to 8, a gap is created directly above the bristle assembly 13, i.e. between the spine 32 and the top 19 of the nozzle 11. This is perhaps best seen in FIGS. 6 to 8. Conceivably, fluff and other dirt drawn into the nozzle 11 may become trapped within this gap. With the tool 50 of FIGS. 9 to 14, on the other hand, the bristle assembly 53 is attached to the top 59 of the nozzle 51. Consequently, fluff and other dirt are prevented from becoming trapped between the bristle assembly 53 and the top 59 of the nozzle 51.

As the tool 51 is swept forwards over the cleaning surface 40, the bristle assembly 53 is swept backwards and contacts the trailing edge 63 of the nozzle 51. A seal is then created between the bristle assembly 53 and the trailing edge 63. The suction generated within the cavity 61 creates a partial vacuum on the trailing side of the bristle assembly 53. Since the suction opening 60 is typically open to ambient, the pressure on the leading side of the bristle assembly 53 is generally higher. Without the through-holes 78,79 in the carrier 70, the difference in pressure on the two sides of the bristle assembly 53 may be sufficiently large that the bristle assembly 53 is forced stuck against the trailing edge 63. Consequently, when the tool 50 is lifted from the cleaning surface 40 in order to reverse the direction of travel, the bristle assembly 53 fails to return to the centre of the suction opening 60. The through-holes 78,79 in the carrier 70 prevent this from happening. The through-holes 78,79 provide a passageway between the leading side and the trailing side of the bristle assembly 53. The through-holes 78,79 thus act to better equalise the pressure on the two sides of the bristle assembly 53. The through-holes do not necessarily result in perfect equalisation. However, the through-holes 78,79 ensure that the pressure difference is not excessive. Consequently, when the tool 50 is lifted from the cleaning surface 40, the resilience of the carrier 70 is sufficient to overcome the pressure difference and return the bristles assembly 53 to the centre of the suction opening 60.

Any through-holes in the carrier 70 may present a trap for fluff or other dirt. If the through-holes were too small, the through-holes may become blocked altogether. Larger through-holes will naturally reduce the likelihood of the through-holes blocking. However, as the number and sizes of the through-holes increase, the holes will have an increasing influence over the behaviour of the carrier 70. In particular, an excessive number of holes or holes that are excessively large may cause the carrier 70 to flex in an undesired manner. The location, number and sizes of the through-holes 78,79 are therefore selected such that the bristle assembly 53 is prevented from sticking against the trailing edge 63 of the nozzle 51 whilst ensuring that the behaviour of the carrier 70 is not adversely affected.

The through-holes 78,79 are formed in a region of the carrier 70 that is proximate the rear 56 of the nozzle 51. Since the connecting duct 52 is located at the rear 56 of the nozzle 51, the suction within the nozzle 51 is generally greatest at the rear 56 of the nozzle 51. Any pressure difference between the leading side and the trailing side of the bristle assembly 53 is therefore likely to be greatest at the rear 56 of the nozzle 51. By locating the through-holes 78,79 in a region of the carrier 70 proximate the rear 56 of the nozzle 51, the number of through-holes may be kept to a minimum whilst ensuring that adequate equalisation of pressure is achieved.

The through-holes 78,79 in the carrier 70 are of different sizes. In particular, the through-hole 78 closest to the rear 56 of the nozzle 51 is larger. Both through-holes 78,79 are of a size that is intended to make blockage of the holes 78,79 unlikely. By having through-holes 78,79 of different sizes, a larger hole 78 can be used towards the rear of the carrier 70 where the pressure difference between the leading and trailing sides of the bristle assembly 53 is likely to be greatest. Since the pressure difference further along the carrier 70 is likely to be smaller, a smaller hole 79 may be used. As a result, the effect that the through-holes 78,79 have on the behaviour of the carrier 70 can be kept to a minimum whilst ensuring that adequate equalisation of pressure is achieved.

The invention claimed is:

1. A tool for a vacuum cleaner, the tool comprising a nozzle and a bristle assembly, wherein a base of the nozzle comprises an elongate suction opening delimited along its length by a leading edge and a trailing edge of the base, the bristle assembly is mounted within the nozzle and protrudes through the suction opening, the bristle assembly comprises a carrier to which a strip of bristles is attached, the carrier is formed of a flexible material and protrudes beyond the suction opening such that the carrier is able to flex to contact the trailing edge, wherein the leading and trailing edges of the base extend longitudinally from a first end of the base to a second end of the base and are raised relative to the first and second ends of the base so that when the first and second ends of the base are in contact with a surface during use, the leading and trailing edges are raised above the surface to be cleaned forming a gap between the nozzle and the surface to be cleaned.

2. The tool of claim 1, wherein the carrier flexes and contacts the trailing edge when the tool is swept over a cleaning surface in a first direction, and the carrier flexes and contacts the leading edge when the tool is swept over the cleaning surface in a second opposite direction.

3. The tool of claim 1, wherein the carrier comprises one or more through-holes.

4. The tool of claim 3, wherein the tool comprises a duct for attachment to a wand or hose of the vacuum cleaner, the suction opening extends from a front to a rear of the nozzle, the duct is attached to the rear of nozzle, and the through-holes are formed in a region of the carrier proximate the rear of the nozzle.

5. The tool of claim 3, wherein the carrier comprises through-holes of different sizes.

6. The tool of claim 3, wherein the tool comprises a duct for attachment to a wand or hose of the vacuum cleaner, the suction opening extends from a front to a rear of the nozzle, the duct is attached to the rear of nozzle, the carrier comprises a first through-hole and a second through-hole, and the first through-hole is larger and located closer to the rear of nozzle than that of the second through-hole.

7. The tool of claim 1, wherein the bristle assembly is attached along a top of the nozzle.

8. The tool of claim 1, wherein the tool comprises a duct for attachment to a wand or hose of the vacuum cleaner, the suction opening extends from a front to a rear of the nozzle, the duct is attached to the rear of nozzle, and the height or width of the nozzle tapers from the rear to the front of the nozzle.

9. The tool of claim 1, wherein the carrier is formed of rubber.

10. The tool of claim 1, wherein the bristles are formed of carbon fibre.

11. A tool for a vacuum cleaner, the tool comprising a nozzle and a bristle assembly, wherein the nozzle comprises an elongate suction opening that extends from a front to a rear of the nozzle, the suction opening is delimited along its length by a leading edge and a trailing edge, the bristle assembly is mounted within the nozzle and protrudes through the suction opening, the bristle assembly comprises a strip of bristles attached to a carrier, the carrier extends beyond the suction opening and is arranged to pivot or flex relative to the nozzle such that, as the tool is swept over a cleaning surface, the carrier pivots or flexes and contacts the trailing edge, and the carrier comprises one or more through-holes that provide airflow passageways between a leading side and a trailing side of the bristle assembly such that the pressure difference between the leading side and the trailing side is reduced by allowing airflow to pass through the through-holes.

12. The tool of claim 11, wherein the carrier pivots or flexes and contacts the trailing edge when the tool is swept over a cleaning surface in a first direction, and the carrier pivots or flexes and contacts the leading edge when the tool is swept over the cleaning surface in a second opposite direction.

13. The tool of claim 11, wherein the tool comprises a duct for attachment to a wand or hose of the vacuum cleaner, the suction opening extends from a front to a rear of the nozzle, the duct is attached to the rear of nozzle, and the through-holes are formed in a region of the carrier proximate the rear of the nozzle.

14. The tool of claim 11, wherein the carrier comprises through-holes of different sizes.

15. The tool of claim 11, wherein the tool comprises a duct for attachment to a wand or hose of the vacuum cleaner, the suction opening extends from a front to a rear of the nozzle, the duct is attached to the rear of nozzle, the carrier comprises a first through-hole and a second through-hole, and the first through-hole is larger and located closer to the rear of nozzle than that of the second through-hole.

16. The tool of claim 11, wherein the bristle assembly is attached along a top of the nozzle.

17. The tool of claim 11, wherein the tool comprises a duct for attachment to a wand or hose of the vacuum cleaner, the suction opening extends from a front to a rear of the nozzle, the duct is attached to the rear of nozzle, and the height or width of the nozzle tapers from the rear to the front of the nozzle.

18. The tool of claim 11, wherein the carrier is formed of rubber.

19. The tool of claim 11, wherein the bristles are formed of carbon fibre.

* * * * *